US006431390B1

(12) United States Patent
Waller

(10) Patent No.: US 6,431,390 B1
(45) Date of Patent: Aug. 13, 2002

(54) LID FOR BEVERAGE CONTAINER

(76) Inventor: David B. Waller, 4025 Carmel View Rd., #124, San Diego, CA (US) 92130

( * ) Notice: Subject to any disclaimer, the term of this patent is extended or adjusted under 35 U.S.C. 154(b) by 7 days.

(21) Appl. No.: 09/766,389

(22) Filed: Jan. 19, 2001

Related U.S. Application Data

(63) Continuation-in-part of application No. 09/970,998, filed on Jun. 21, 2000, which is a continuation of application No. 09/337,451, filed on Jun. 21, 1999.

(51) Int. Cl.[7] ..... B65D 41/00
(52) U.S. Cl. ..... 220/713; 220/719
(58) Field of Search ..... 220/719, 717, 220/713, 716

(56) References Cited

U.S. PATENT DOCUMENTS 4,394,928 A * 7/1983 Philip ..... 220/719 X
4,503,992 A * 3/1985 Sitko et al. ..... 220/713
4,619,372 A * 10/1986 McFarland ..... 220/713
5,509,568 A * 4/1996 Warden et al. ..... 220/713 X
5,820,016 A * 10/1998 Stropkay ..... 220/713 X
6,079,588 A * 6/2000 Khafizov ..... 220/717 X
6,220,476 B1 * 4/2001 Waller ..... 220/719

* cited by examiner

*Primary Examiner*—Steven Pollard
(74) *Attorney, Agent, or Firm*—David B. Waller & Associates

(57) ABSTRACT

A lid for a beverage container, the lid comprising; a top wall having a generally circular periphery; a groove extending downward from said top wall having a front side adjacent to the circular periphery, a back side more distant from the circular periphery than the front side and a drinking opening in the front side; a barrier extending downward from the top wall between and generally parallel to the circular periphery and the groove; and an annular mounting portion along the circular periphery for sealingly engaging the lid of the beverage container; the lid enabling mobility of the beverage container without spillage of a beverage.

9 Claims, 4 Drawing Sheets

LID FOR BEVERAGE CONTAINER

CROSS-REFERENCE TO RELATED APPLICATIONS

This application is a continuation-in-part of patent application Ser. No. 09/970,998 filed on Jun. 21, 2000 as a continuing patent application of pending U.S. application Ser. No. 09/337,451 filed Jun. 21, 1999.

FIELD OF INVENTION

This invention relates to a lid for the use in combination with a beverage container and more particularly to a lid enabling drinking from the container without removal of the lid and which prevents spillage during use.

BACKGROUND OF THE INVENTION

Beverage container lids adapted to fasten over the rim or lip of disposable beverage containers are well known. Such lids reduce spillage and evaporation of the beverage within the container and help insulate the contents of the container from the external ambient temperature. In their most simple form, such beverage container lids comprise a generally flat lid surface in the form of a disk having a peripheral sealing skirt for securing the lid to the rim of the beverage container. While such lids are entirely suitable for the purposes just described, they must be completely removed in order to gain access to the contents of the container.

This problem has been substantially reduced for cold beverages by providing a selectively opened straw orifice in the lid. This allows access to the contents of the container without removing the lid. Unfortunately, the use of a straw for hot beverages such a coffee or hot chocolate is generally not preferred.

Improved container lids for hot beverages which include an openable tear strip or flap have been devised. See for example U.S. Pat. Nos.: 3,868,043, 3,977,559, 4,090,660, and 4,210,272. Such modified beverage container allowing limited access to the contents of the container while still covering most of the open end of the container. However, this type of lid has the disadvantage of providing a direct path from which the beverage in the container can easily spill during use.

Further improvements have been made to the beverage container lids including fold back flaps, see U.S. Pat. Nos. 3,994,411, 4,202,459, 4,322,015, 4,473,167, 4,629,088, 4,738,373, 5,090,584, 5,111,961, 5,183,172, 5,197,624 and 5,613,619. These fold back flaps and various means for securing tear strip or flap in its fully folded back configuration have been provided. For example, U.S. Pat. No. 3,994,411 discloses a container lid having a fold-back flap which includes a pull tab along its outermost edge. The pull tab may be inserted into a slit along the outermost edge of the lid to hold the flap in its fully open position. U.S. Pat. No. 4,202,459 discloses an embossed slot formed in the upper surface of the lid which is able to receive the peripheral skirt of the lid when the flap is fully folded back. Finally, U.S. Pat. No. 4,322,015 discloses a container lid having a fold-back flap which is secured by one or more retainer studs which project upward from the upper surface of the lid. Although each of these designs is functional, there are several disadvantages, in particular, the openable flaps frequently become dislodged from their retaining means and are difficult to hold in the open position. In the case of recloseable flaps, they often do not adequately seal the opening when closed and are difficult to hold in the closed position.

Moreover, it is frequently necessary to employ relatively heavy gauge or stiff materials in order to achieve a highly reliable fastening system which is more expensive. Another disadvantage results when the flaps do not tear accurately along the intended line and form sharp edges at each side of the opening thereby formed in the rim or skirt of the container lid which causes discomfort during use. Furthermore, once the flap has been released the lid edges on either side of the opening are difficult to secure to the container lip and do not make an adequate seal allowing the contents of the container to spill from these edges during normal use.

Consequently, a lid which does not have to be removed from the beverage container, does not suffer from the disadvantages discussed above and significantly reduces or prevents spillage during normal use is needed.

SUMMARY OF THE INVENTION

In accordance with the present invention a lid is provided for a beverage container, wherein the lid comprises: a top wall having a generally circular periphery; a groove extending downward from said top wall having a front side adjacent to said circular periphery, a back side more distant from said circular periphery than said front side and a drinking opening in said front side; a barrier extending downward from said top wall between and generally parallel to said circular periphery and said groove; and an annular mounting portion along said circular periphery for sealingly engaging the lid of the beverage container; said lid enabling mobility of the beverage container without spillage of a beverage.

In another embodiment, the present invention provides a lid comprising; a top wall having a generally circular periphery; an annular side wall depending from the top wall about its circular periphery; a groove extending downward from said to wall having a front side adjacent to said circular periphery, a back side more distant from said circular periphery than said front side and a drinking opening in said front side; a barrier extending downward from said top wall between and generally parallel to said circular periphery and said groove; and an annular mounting portion at the bottom of said side wall for sealingly engaging the lid of the beverage container; said lid enabling mobility of the beverage container without spillage of the beverage.

In another embodiment, the present invention provides a lid comprising; a top wall having a generally circular periphery; a drinking spout formed in the top wall and along a portion of said circular periphery, said drinking spout having a top side and a sloped side wall extending from the top wall to said top side; a groove extending downward from said top side of said drinking spout having a front side adjacent to said circular periphery, a back side more distant from said circular periphery than said front side and a drinking opening in said front side; a barrier extending downward from said top side of said drinking spout between and generally parallel to said circular periphery and said groove; and an annular mounting portion at the bottom of said side wall for sealingly engaging the lid of the beverage container; said lid enabling mobility of the beverage container without spillage of the beverage.

In other embodiments the lid further comprises a vent hole in the top wall adjacent to the drinking opening.

In another embodiment the combination of the lid engaged with a beverage container is provided.

DETAILED DESCRIPTION OF THE INVENTION

Figure 1:
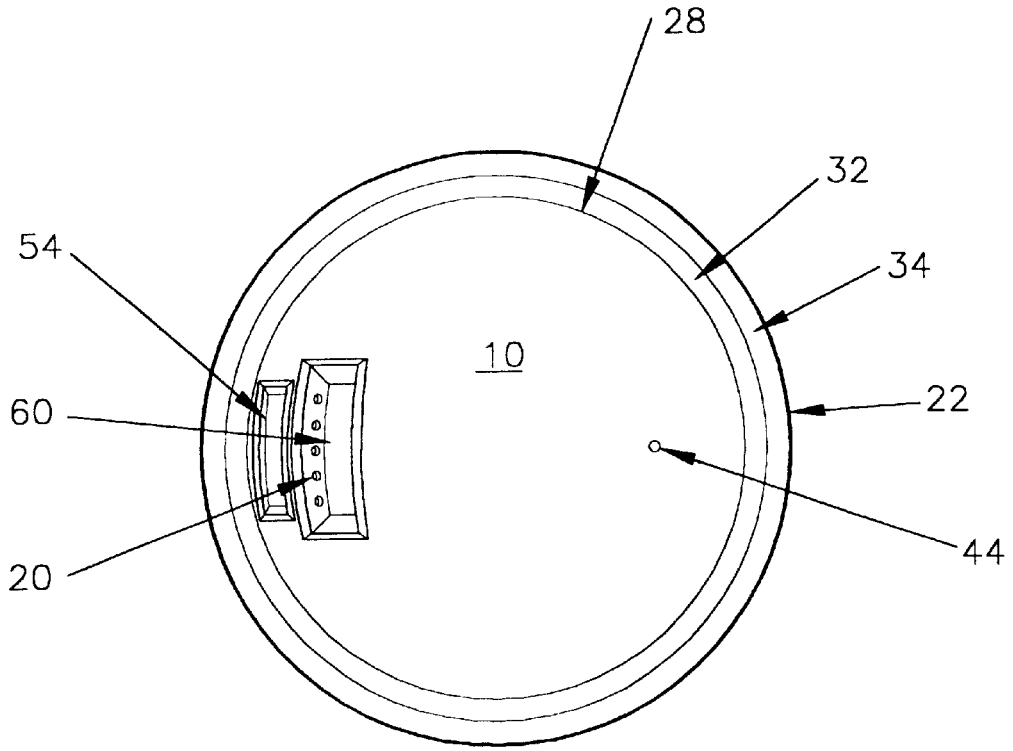
FIG. 1 is a top view of the lid for a beverage container having a groove and a barrier generally perpendicular to the top wall.

Referring to FIG. 1 through 7 in detail, the lid 10 provides a cover for a beverage container 12 which inhibits spillage and reduces heat transfer between the beverage and the exterior surrounding atmosphere. Container lids 10 according to the present invention may be fabricated from a variety of materials which may be formed into the desired configuration (e.g. via vacuum molding). Preferably, the lid 10 is made of one piece plastic construction, which enables it to be manufactured relatively inexpensively and may therefore be disposable. In addition, one skilled in the art could identify obvious variations of the present invention that would provide manufacturing the lid 10 in more than one piece for assemblage prior to distribution or use. Furthermore, the lid 10 may be constructed of heavier materials and accompanied by a similarly constructed beverage container 12 so that the lid 10 and container 12 are reusable.

Suitable materials include thermoplastics such as for example, high density polyethylene, polyvinyl chloride, polypropylene, polystyrene, acrylonitrile-butadiene-styrene copolymer, polyvinylacetate, polyvinylbutyral, cellulose acetate, cellulose acetate butyrate, cellulose nitrate and the like. Particularly, impact polystyrene and copolymers comprising at least 90 percentage by weight of styrene monomer component is preferred which combines the advantages of low cost, high strength, ease of fabrication, and desirable mechanical properties, such as resilience.

The thickness of the material of the lid 10 is selected to provide satisfactory strength while enabling enough flexibility to facilitate engagement of the beaded lip 16 of the beverage container 12 by the annular mounting portion 18 of the lid 10. The thickness of the thermoplastic material may vary within a relatively wide range, typically being from about 0.08 to 1.2 mm. More specifically, a material in the range from about 0.6 to 1.0 mm is preferred. Also, as noted above, the lid 10 requires a relatively small amount of material, which enables it to be produced economically. Accordingly, if it is desirable that the lid 10 be reusable, it may be constructed of a variety of substantially thicker materials known to those skilled in the art.

The lid 10 maybe secured in place on the container 12 by an annular mounting portion 18 which engages the rim or lip 14 of the container 12. The annular mounting portion 18 includes a resilient annular gripping portion 32 configured to grip the bead 16 on the lip 14 of the container 12. To facilitate mounting of the lid 10 on the container 12 and movement of the gripping portion 32 into gripping engagement with the bead 16, the mounting portion 18 may further include an outwardly flared skirt 34 depending from the gripping portion 32. As the lid 10 is pushed downwardly onto the lip 14 of the container 12, the skirt 34 aids in centering the lid 10 and in deflecting the gripping portion 32 to an open position to enable it to fit over the bead 16.

The container lid 10 may include a plurality of annular channels and annular ridges (not shown in the Figures) which act to reinforce the lid 10 and make it more rigid. The number of such reinforcement channels and ridges is not critical, and the provision of such features is well known the prior art.

After the vacuum forming operation has been completed the openings 20 and 44 may be formed in the lid 10. The drinking opening 20 maybe formed during the molding process, with a punch and die or by puncturing with a pointed tool creating one or more openings sufficiently large enough to allow the beverage in the container 12 to flow into the drinking spout 30.

The vent hole 44, maybe formed in the top wall 26 opposite the drinking opening 20 to enable air to flow into the container 12 as the user drinks from the container 12 to facilitate the flow of the liquid out of the container 12 through the drinking opening 20. The vent hole 44 is preferably smaller than the drinking opening 20, and may be formed simply by puncturing the top wall 26 of the lid 10 with a pointed tool.

Figure 6:
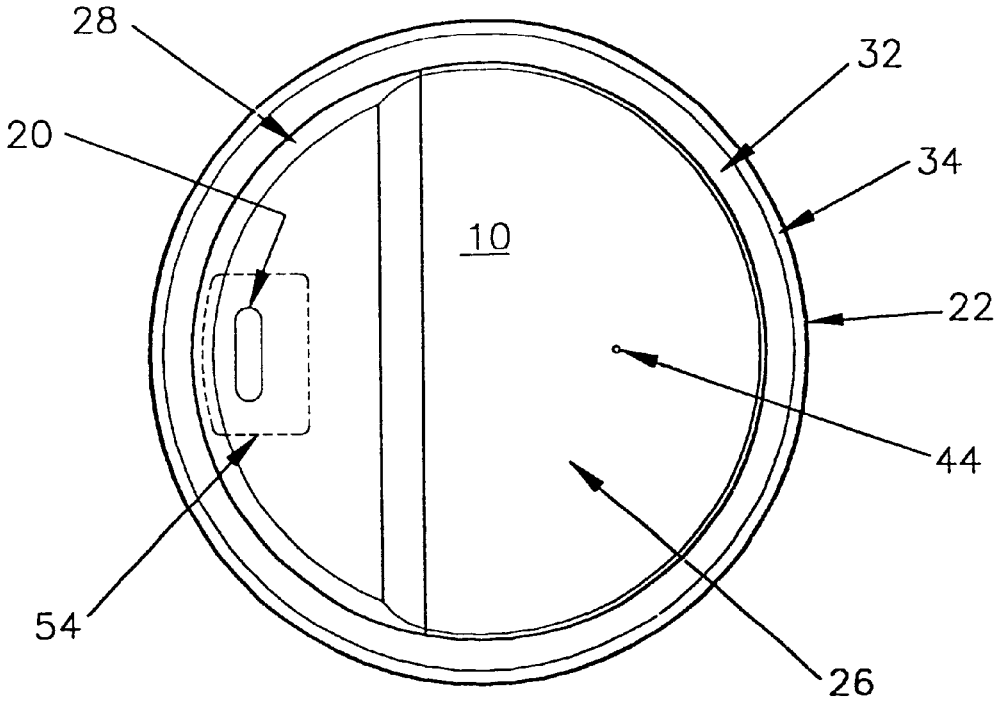
FIG. 6 is a top view of the lid for a beverage container having a spout and a barrier generally parallel to the top wall.
Figure 7:
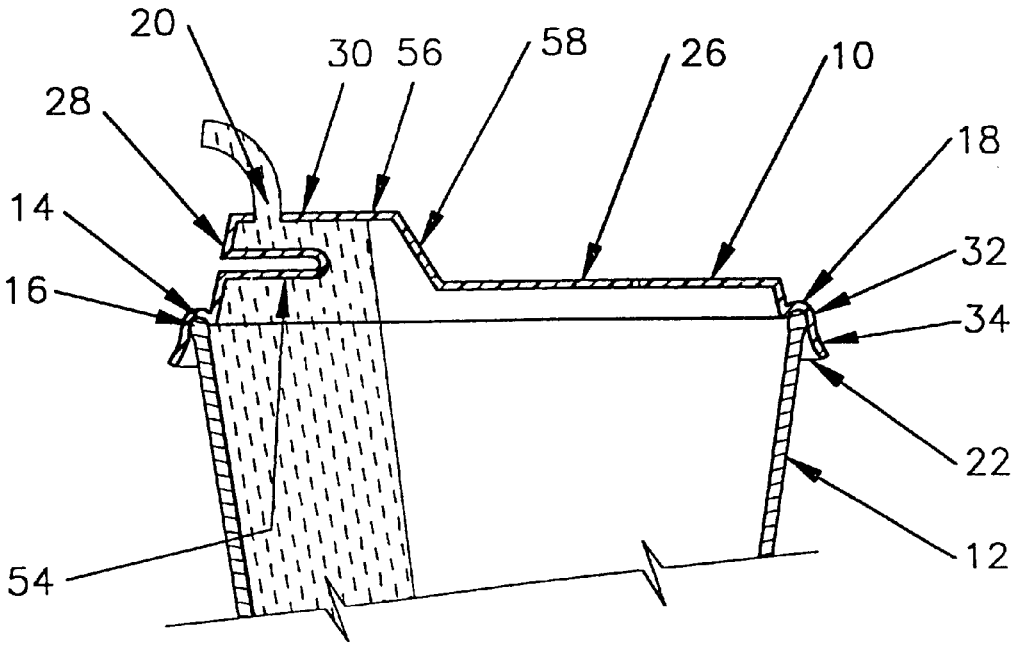
FIG. 7 is a side view of the invention presented in FIG. 6.

In the FIGS. 6 and 7, the drinking opening 20 is positioned at a distance sufficient to enable the user to drink from the opening 20 without contacting the bottom edge 22 of the lid 10 with his/her lower lip, resulting in discomfort.

Up until this point, the construction of the lid 10 has been conventional. However, the lid 10 includes novel and improved means for preventing spillage of the contents of the beverage container 12 during normal use.

Figure 2:
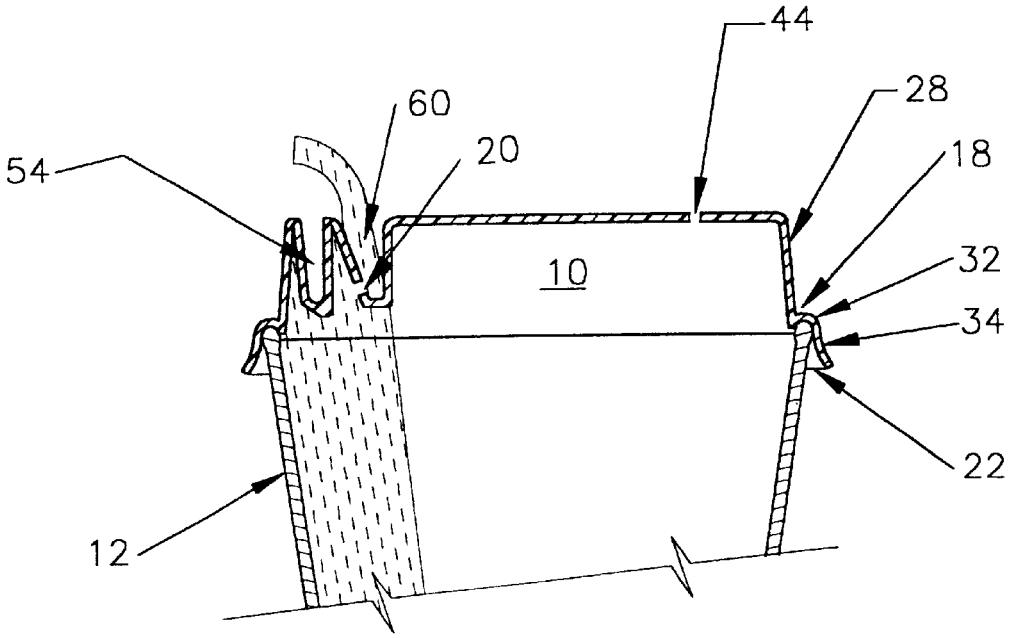
FIG. 2 is a cross-sectional view of the lid for a beverage container presented in FIG. 1.
Figure 3:
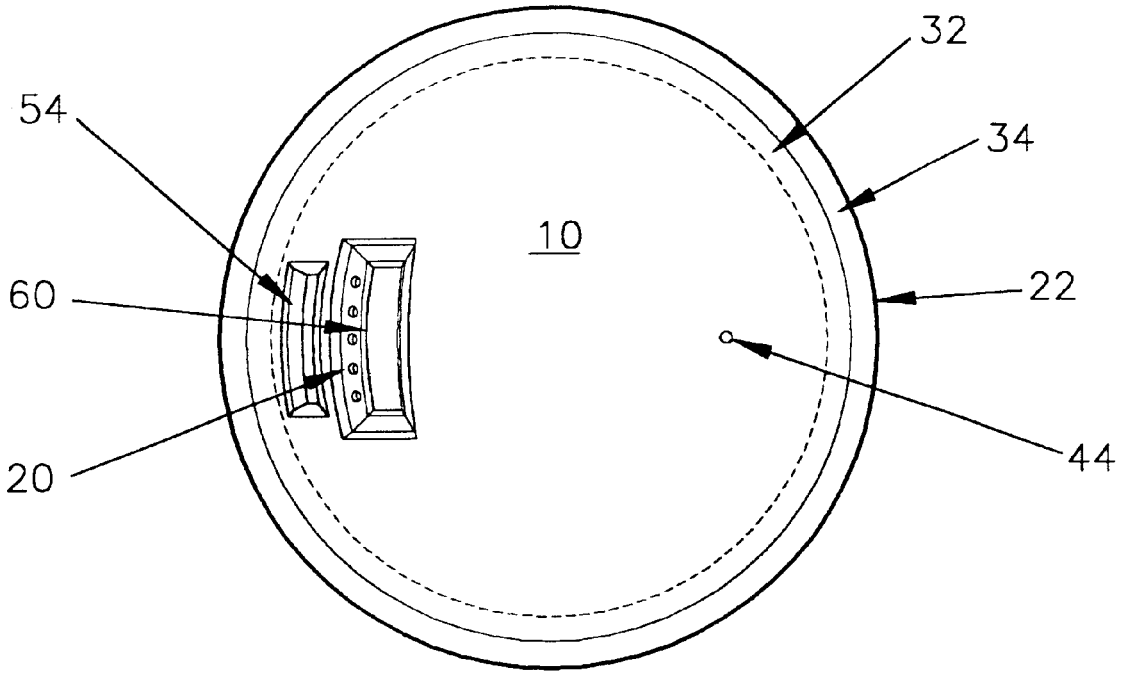
FIG. 3 is a bottom view of the lid for a beverage container presented in FIG. 1.

In FIGS. 1, 2 and 3 a groove 60 extends downwardly from the top wall 26 having a front side adjacent to the annular side wall 28 and a backside more distant from the annular side than the front side. A drinking opening 20 is preferably provided in the front side of the groove 60. The drinking opening 20 may be a single opening or a plurality of smaller openings. If it is a single opening it is preferably an elongated oval or rectangle shape of about ¼" to about ¾" in length and from about 1/64" to 1/16" in width. If the drinking opening 20 is formed of a plurality of smaller openings they are preferably circular openings of about 1/16" to about ⅛" in diameter. The groove 60 can be of any desired shape and is preferably rectangular in shape at the top wall 10 and narrowing at its base. The narrowing may be the result of angling of the front side of the groove 60, the backside of the groove 60, or both the front side and the backside of the groove 60. Preferably the narrowing is a result of angling of the front side of the groove 60 while maintaining the backside generally perpendicular to the top wall 10. This configuration and other configurations contemplated by the present invention place the drinking opening 20 within the groove 60 such that when fluid attempts to escape it is directed through the drinking opening 20 to impact the backside of the groove 60 and be retained within the base of the groove 60. In addition, the drinking opening 20 may be placed in a variety of locations within the groove 60 most preferably such that fluid may return to the beverage container 12 and that any amount retained within the groove 60 is reduced to a minimum.

The barrier 54 is positioned between the groove 60 and the annular side wall 28, This barrier may be formed in a variety of conformations including for example a groove similar to groove 60 or a sheet of material. The barrier 54 extends to a depth equal to or greater than the groove 60 and is positioned in front of the drinking opening 20 and is of a length equal to and preferably greater than the length of the drinking opening 20. The barrier 54 may be provided in a number of configurations that prevent fluid from exiting the drinking opening 20. For example, if the beverage container 12 is jarred fluid moving up the container wall toward the lid 10 will be bracketed between the barrier 54 and the annular side wall 28 and redirected back into the beverage container 12 away from the drinking opening 20. In general the barrier 54 acts as a wall preventing fluid from exiting the beverage container 12 without first flowing around and over the barrier 54.

Figure 4:
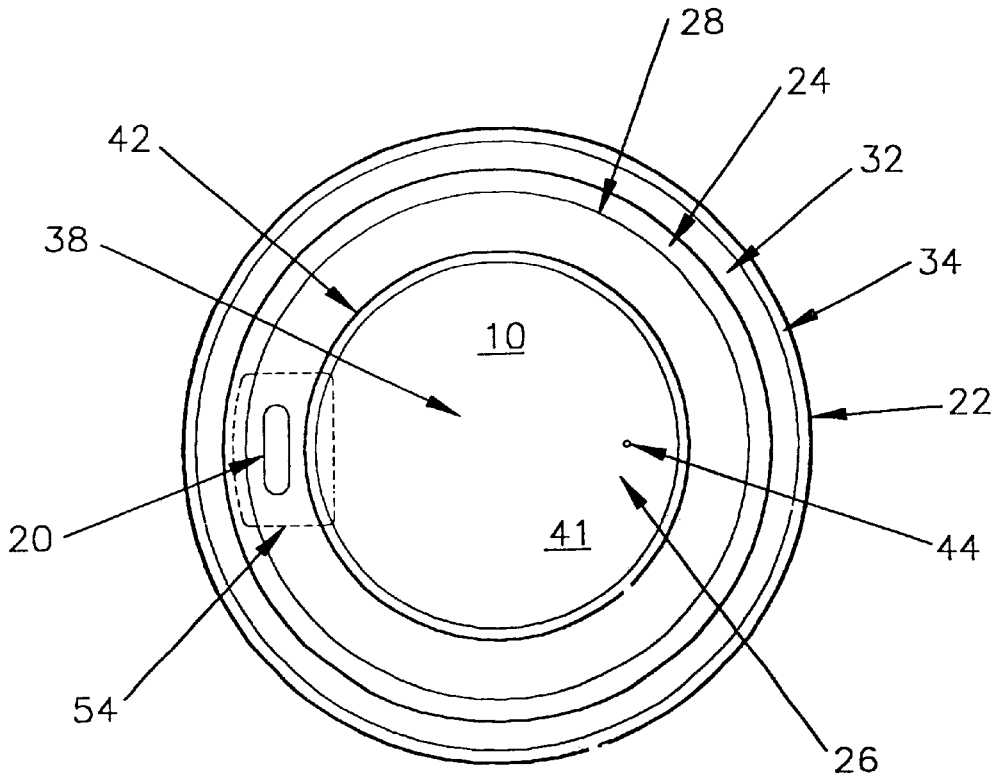
FIG. 4 is a top view of the lid for a beverage container having a top wall and a barrier generally parallel to the top wall.
Figure 5:
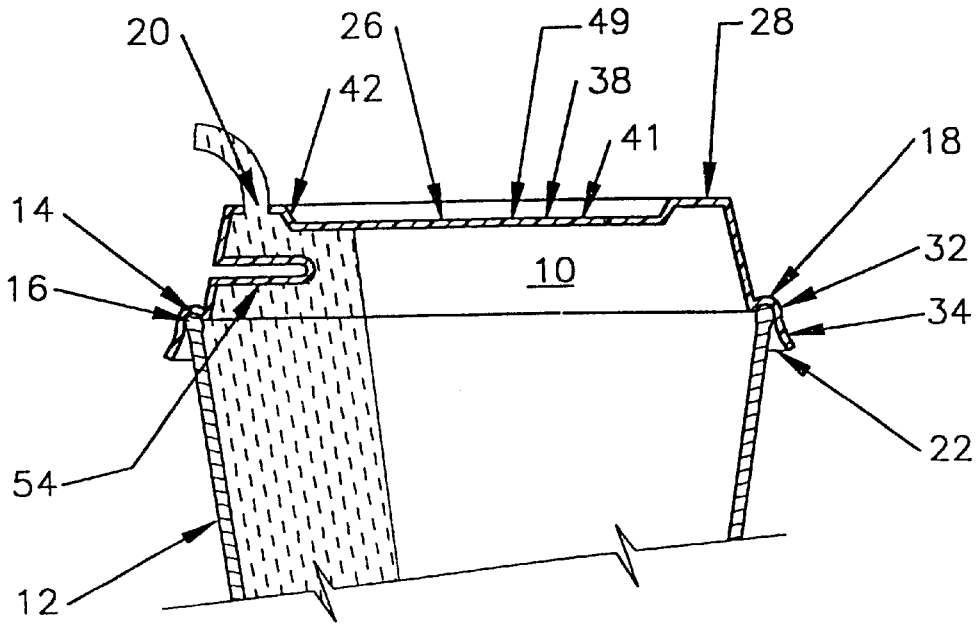
FIG. 5 is a side view of the invention presented in FIG. 4.

In FIGS. 4 and 5 a barrier 54 extends from the annular side wall 28 of the lid 10 generally parallel to the top wall 26 and adjacent to the drinking opening 20 to prevent the direct flow of the beverage from the beverage container 12 through the drinking opening 20. The barrier 54 acts as a wall preventing the beverage from exiting the beverage container 12 without first flowing around the barrier 54. The barrier 54 may be a hollow formed wall or a thin sheet of material adjacent to and having a dimension which is larger than the drinking opening 20. It may be anchored to the annular side wall 28 or to the top wall 26 and the annular side wall 28. Alternatively, the barrier 54 may form a chamber larger than and around the drinking opening 20 anchored to the top wall 26 and the annular side wall 28. The chambers side walls may have a single opening, several small openings such as slits grooves, holes, perforations or the like which allow the beverage to enter the chamber and then exit the drinking opening 20 but prevent the beverage from spilling by prohibiting direct flow of the beverage from the drinking opening 20. A variety of shapes may be utilized for the barrier 54, for example, a planar barrier 54 which is parallel to the top wall 26 may be used which is larger that the drinking opening 20. Alternatively, the barrier 54 may be curved in shape, parallel to the top wall 26, and may be oriented such that the concave portion of the barrier 54 faces the internal beverage chamber of the container 12 and the convex portion of the barrier 54 faces the drinking opening 20. This curved shaped will allow any beverage which remains on the barrier 54 to quickly flow to one side of the barrier 54 or the other and be deposited back into the beverage container 12. The barrier 54 could also be curved in shape wherein the concave portion is larger than and facing the drinking opening 20 and angled such that the barrier 54 slopes downward as it extends from the annular side wall 28 thereby allowing any beverage which remains in the concave portion to flow with the slope of the barrier 54 and be deposited back into the beverage container 12.

In another aspect of the invention a fluid channel (not shown in the Figures) is provided in the lid 10 comprised of a fluid path to prevent the direct flow of the beverage from the beverage container 12. In general, the fluid channel provides an indirect fluid path that interferes with the beverages direct access to the drinking opening 20 to prevent spillage during use. The channel can be constructed in a variety of configurations. As an example and not by way of limitation, the chamber may have an entrance opening or openings which allows the beverage in the container 12 to enter the fluid channel wherein the beverage travels in the channel then makes a 180 degree turn, continues along the channel and then exits out of the drinking opening 20 thereby preventing direct flow of the beverage from the beverage container 12.

In FIGS. 6 and 7 a drinking spout 30 is formed in the top wall 26 and along the circular periphery as described above, however, the drinking spout 30 defines a chamber comprised of a top portion 56 having a drinking opening 20, a sloped side wall 28 which extends from the top wall 26 to the top portion 56, a barrier 54 formed in and perpendicular to the annular side wall 28 and a bottom portion 52 having a fluid opening 50 in line with the barrier 54. The bottom wall 52 acting to restrict the flow of the beverage from the container 12 into the chamber. The fluid opening 50 of the bottom wall 52 may be a single opening, several small openings such as slits, grooves, holes, perforations or the like which allow the beverage to enter the chamber. The barrier 54 acts as a wall preventing the beverage from exiting the beverage container 12 without first flowing around the barrier 54. The barrier 54 may be constructed in a variety of ways including those discussed above.

In general, the invention encompasses a variety of beverage container lids 10 which utilize a barrier 54 or flow channel which prevents direct flow of the beverage from the drinking opening 20 to prevent spillage during use.

A further benefit of the present invention appears to reside in a substantial reduction in the amount of litter attendant to its use. While most lids are often discarded in an uncontrolled and careless manner, the beverage containers themselves tend to be disposed of in a significantly more circumspect and acceptable manner. The problem of container lid litter is so acute that fast food chains and other food and beverage providers prefer not to apply their names or otherwise identify themselves on the container lids employed by their food or beverage product containers. The container lids of the present invention, however, are not normally removed from the containers during use and in preferred embodiments do not contain removable or separable access strips which may be discarded in an unacceptable manner nor are the access strips forming part thereof separable therefrom. Accordingly, the use of the container lids of the invention tend to inhibit the unrestricted disposal of parts thereof or disposal of the lids apart from their corresponding containers. Therefore, adoption of the container lids of the invention could conceivably lead to substantial reductions in the nationwide problem of litter.

The lid 10 described above is particularly suitable for use in a variety of food distribution establishments including fast food franchises, street vendors, airlines, a carry-out counter in a restaurant or any vendor which provides the user with beverages for consumption while the user is in motion. A vendor can fill a container with coffee or the like and apply the lid quickly and simply by snapping it onto the container. The user may then drink from the container while walking or riding in a vehicle without removing or penetrating the lid and without spillage.

Various vibrations and motion tests have been conducted on the container lids of the invention. No spillage occurred under these tests, even under aggravated conditions. Various beverages, such as hot coffee and iced cold water, were tested with the lid in comparison to other currently used lids. The amount of spillage during agitation was eliminated. The thermal state of the beverage was maintained for a similar period with the container lids of the invention secured to the containers.

The preferred embodiments are provided by illustration and not by way of limitation. There is no intent to limit the scope of the invention to this or any other particular embodiment.

What is claimed is:

1. A lid for a beverage container, the lid comprising;

(a) a top wall having a generally circular periphery;

(b) a groove extending downward from said top wall having a front side adjacent to said circular periphery, a back side more distant from said circular periphery than said front side and a drinking opening in said front side;

(c) a barrier extending downward from said top wall between and generally parallel to said circular periphery and said groove; and (d) an annular mounting portion along said circular periphery for sealingly engaging the lid of the beverage container;

said lid enabling mobility of the beverage container without spillage of a beverage.

2. The beverage container lid according to claim 1 wherein the lid further comprises a vent hole in the top wall opposite the drinking opening.

3. The beverage container lid according to claim 1 in combination with a beverage container having a generally circular rim with a bead formed thereon able to engage the annular mounting portion of the lid.

4. A lid for a beverage container, the lid comprising;

(a) a top wall having a generally circular periphery;

(b) an annular side wall depending from the top wall about its circular periphery;

(c) a groove extending downward from said top wall having a front side adjacent to said circular periphery, a back side more distant from said circular periphery than said front side and a drinking opening in said front side;

(d) a barrier extending downward from said top wall between and generally parallel to said circular periphery and said groove; and (e) an annular mounting portion at the bottom of said side wall for sealingly engaging the lid of the beverage container;

said lid enabling mobility of the beverage container without spillage of the beverage.

5. The beverage container lid according to claim 4 wherein the lid further comprises a vent hole in the top wall opposite the drinking opening.

6. The beverage container lid according to claim 4 in combination with a beverage container having a generally circular rim with a bead formed thereon able to engage the annular mounting portion of the lid.

7. A lid for a beverage container, the lid comprising;

(a) a top wall having a generally circular periphery;

(b) a drinking spout formed in the top wall and along a portion of said circular periphery, said drinking spout having a top side and a sloped side wall extending from the top wall to said top side;

(c) a groove extending downward from said top side of said drinking spout having a front side adjacent to said circular periphery, a back side more distant from said circular periphery than said front side and a drinking opening in said front side;

(d) a barrier extending downward from said top side of said drinking spout between and generally parallel to said circular periphery and said groove; and (e) an annular mounting portion at the bottom of said side wall for sealingly engaging the lid of the beverage container;

said lid enabling mobility of the beverage container without spillage of the beverage.

8. The beverage container lid according to claim 7 wherein the lid further comprises a vent hole in the top wall opposite the drinking opening.

9. The beverage container lid according to claim 7 in combination with a beverage container having a generally circular rim with a bead formed thereon able to engage the annular mounting portion of the lid.

* * * * *